US007325677B2

(12) United States Patent
Gelardi et al.

(10) Patent No.: US 7,325,677 B2
(45) Date of Patent: Feb. 5, 2008

(54) GRAPHIC BOOK COVER SYSTEM

(75) Inventors: Tatiana L. Gelardi, Kennebunkport, ME (US); Anthony L. Gelardi, Cape Porpoise, ME (US); Michael Thrower, Scarborough, ME (US)

(73) Assignee: TJGel, LLC, Biddeford, ME (US)

( * ) Notice: Subject to any disclaimer, the term of this patent is extended or adjusted under 35 U.S.C. 154(b) by 384 days.

(21) Appl. No.: 10/921,351

(22) Filed: Aug. 19, 2004

(65) Prior Publication Data

US 2005/0145514 A1 Jul. 7, 2005

Related U.S. Application Data

(60) Provisional application No. 60/495,890, filed on Aug. 19, 2003.

(51) Int. Cl.
*B65D 85/57* (2006.01)

(52) U.S. Cl. ..... 206/308.1; 206/232; 206/387.1; 206/472

(58) Field of Classification Search ..... 206/232, 206/307, 307.1, 308, 308.1, 311–313, 387.12, 206/387.13, 472, 473, 475, 497; 493/189, 493/199, 267

See application file for complete search history.

(56) References Cited

U.S. PATENT DOCUMENTS 4,823,950 A * 4/1989 Roze ..... 206/311
6,179,121 B1 * 1/2001 Ferguson et al. ..... 206/311
6,186,319 B1 * 2/2001 Schmidt et al. ..... 206/232
6,186,327 B1 * 2/2001 Hadden ..... 206/472
6,935,494 B2 * 8/2005 Fraser et al. ..... 206/312
6,981,586 B2 * 1/2006 Onmori et al. ..... 206/232
2003/0196916 A1 * 10/2003 Jakobowicz ..... 206/308.1
2005/0103659 A1 * 5/2005 Gelardi et al. ..... 206/308.1

* cited by examiner

*Primary Examiner*—Luan K Bui
(74) *Attorney, Agent, or Firm*—James Creighton Wray; Clifford D. Hyra

(57) ABSTRACT

The present invention is a system for labeling and displaying information on one or more data storage packages. The present invention relates particularly to providing covers with information on the outer surfaces of compact disc, DVD and other product containers. Labels may be attached to stacks of one or more rigid holders in order to display information on the cover, spine or base. Printed graphic cards may be inserted between the rigid plastic holders and covers of clear, flexible cover material. The clear cover material is formed into a clear pocket attached at the opening edge of the rigid cover and base. Alternatively, printed graphic cards are adhered to the outer rigid holders by placing adhesive on the cover and base holders but not on the spines. Also, a clear pocket may be attached to the spine of a stack of rigid holders with a printed graphic insert sliding into the pocket.

16 Claims, 10 Drawing Sheets

GRAPHIC BOOK COVER SYSTEM

This application claims the benefit of U.S. Provisional Application No. 60/495,890, filed Aug. 19, 2003.

BACKGROUND OF THE INVENTION

Data storage devices are delicate devices that are easily damaged by scratches, dirt and other consequences of handling. As such, there is a need for carrying and storing cases and other devices that protect compact discs, DVDs and other products during transporting and between uses.

Present solutions to this problem in packaging involve cases that allow the user to carry multiple discs at once. However, not all of these devices are easy to use.

Many existing systems for transporting data storage devices do not allow secure and simple movement of multiple discs.

Needs exist for improved methods for storing, protecting and transporting data storage devices in a less expensive and more secure manner.

SUMMARY OF THE INVENTION

The present invention is a system for labeling and displaying information on product containers and data storage packages. The present invention relates particularly to providing information on the outer surfaces of containers, such as compact disc and DVD containers. Labels may be attached to stacks of one or more rigid holders in order to display information on the cover, spine or base.

In one embodiment, a film of clear, flexible material surrounds one or more rigid holders. Rigid covers and bases are formed with upward and downward facing rims, respectively. The holders, cover and base are hinged together with living hinges on insert strips inserted in spine sections of the holders, cover and base or by other hinging means.

The clear, flexible material is sonically welded, glued, heat stamped or otherwise attached to an edge portion of a cover rigid holder opposite the spine. The clear, flexible material is then wrapped across the cover, bent around the spine and wrapped around the rigid base. The end of the clear, flexible material is then sonically welded, glued, heat stamped or otherwise attached to the edge of the rigid base that is opposite to the spine.

The clear, flexible material is not bound to the spine. When the rigid cover and base are lifted away from center rigid holders, the clear flexible material also lifts up away from the cover, base and spine. A graphic insert is then slid between the clear, flexible material and the cover, base and spine. When the rigid cover and base are returned to a closed position, the flexible graphic insert is trapped within the cover and base rims and under the clear, flexible material.

In another embodiment, a hard cover has a flexible spine and rigid covers that are attached to a rigid cover and base on a hinged stack of one or more holders. The hard cover has a cover and a base that are the same size or about the same size as the hinged rigid holders and the hinged rigid cover and base. The hard cover has graphics printed on it. A flexible spine section connects the cover and base of the hard cover. The flexible spine section is slightly longer than the combined height of the rigid cover, rigid base and the spine of the stack of holders. The hard cover is mechanically attached to the cover and base stack of rigid holders. Glue or another adhesive is placed on the cover and base of either the hard cover or the stack of holders. No adhesive is applied to the spine. The hard cover is then attached to the stack of rigid holders.

The top cover and bottom base of the assembled rigid holders have recessed areas that are surrounded by a rim. The glue strips fit in the recessed areas, and edges of the hard cover extend slightly beyond the rims.

Alternatively, a soft cover fits into the recesses of the cover and base. When fully attached, the soft cover is flush against the rims of the recessed areas on the rigid cover and base.

The outer covers may have rigid or flexible covers and bases. The spine section may be flexible, like the binding of a book. The outer cover and base are made of rigid or flexible material, while the spine is made of a flexible material.

Another graphic insert method uses a spine pocket. An envelope of clear material is sized to match the dimensions of the spine of a stack of holders. The ends of the clear envelope are open to allow a graphic insert to slide in. The clear envelope is sonically sealed or otherwise attached to the cover and base of the stacked holders along the two sealed sides of the envelope. Then, a graphic insert is slid into the pocket on the spine of the stack of rigid holders. This embodiment may also be combined with a clear or printed outer cover system.

These and further and other objects and features of the invention are apparent in the disclosure, which includes the above and ongoing written specification, with the claims and the drawings.

DETAILED DESCRIPTION OF THE PREFERRED EMBODIMENTS

The present invention is a system for labeling and displaying information on one or more data storage packages. The present invention relates particularly to providing covers with information on the outer surfaces of compact disc, DVD and other product containers. Labels may be attached to stacks of one or more rigid holders in order to display information on the cover, spine or base. Printed graphic cards may be inserted between the rigid plastic holders and covers of clear, flexible cover material. The clear cover material is formed into a clear pocket attached at the opening edge of the rigid cover and base. Alternatively, printed graphic cards are adhered to the outer rigid holders by placing adhesive on the cover and base holders but not on the spines. Also, a clear pocket may be attached to the spine of a stack of rigid holders with a printed graphic insert sliding into the pocket.

Figure 1:
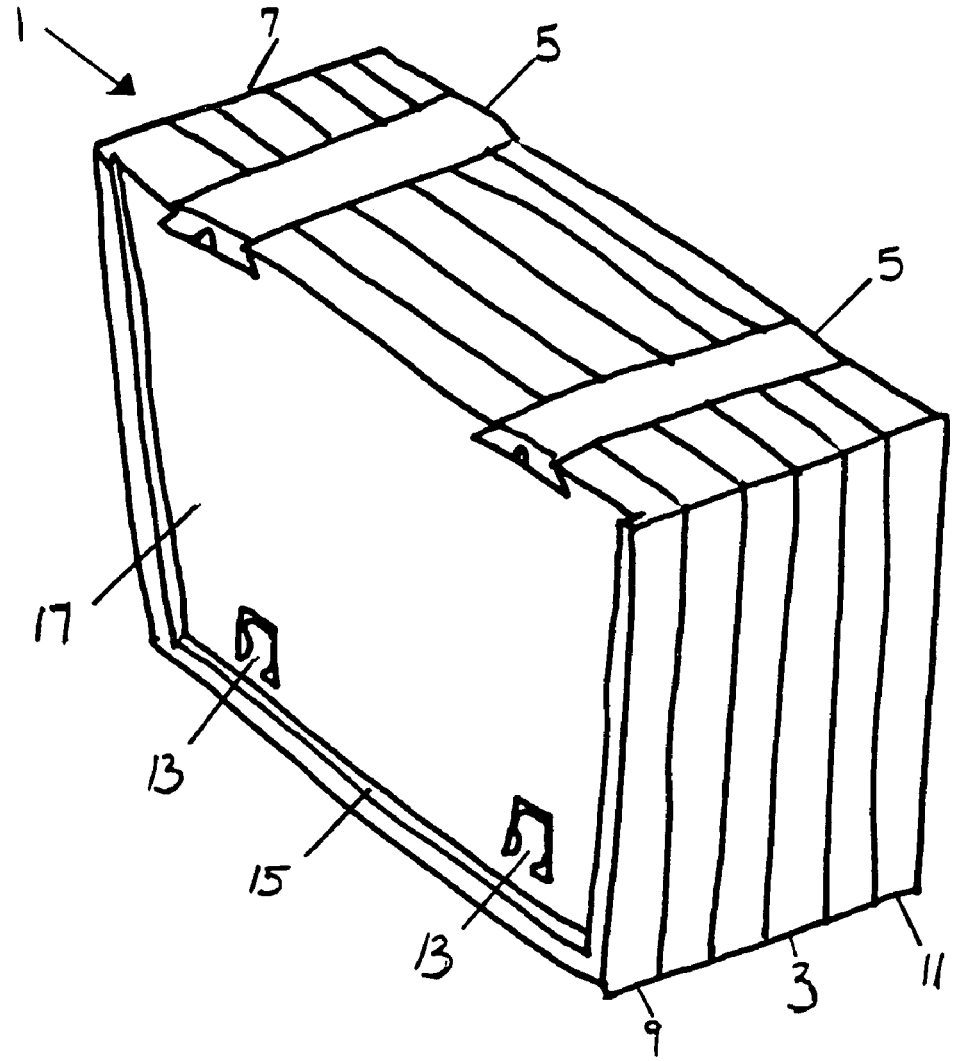
FIG. 1 is a diagram of a stack of rigid holders.

FIG. 1 shows a stack of rigid holders 1 for holding compact discs, DVDs, or other media products. Individual holders 3 are stacked on top of one another. A stack of rigid holders 1 may consist of one or more individual holders 3 up to the desired size. The individual holders 3 are bound together using a hinge mechanism. Preferably, the individual holders are bound together by mechanical clips 5, attaching along the spine 7 of each individual holder 3, that lock the individual holders 3 into position. The mechanical clips 5 have hinges that allow the stack of rigid holders 1 to flex and open like a book, with the individual holders 3 acting as pages.

The stack of rigid holders 1 has a specially designed cover holder 9 and base holder 11. The rigid cover 9 and base 11 are formed with upward and downward facing rims, respectively. The holders 1, cover 9 and base 11 are hinged together with living hinges on insert strips inserted in spine sections of the holders 1, cover 9 and base 11. The cover holder 9 or base holder 1 may have molded clips 13 that are designed to hold printed pamphlets of information. The cover 9 and base 11 may also have raised ridges 15 running along the outer edges of the holders, except for the spine edge. This leaves a central flat section 17 on the cover 9 and base 11 holders.

Figure 2:
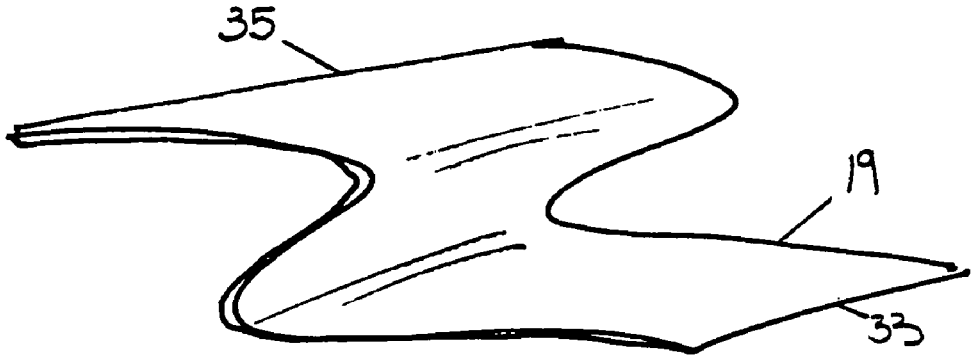
FIG. 2 is a diagram of a clear, flexible sheet.

FIG. 2 shows a sheet of clear, flexible cover material 19. The cover material 19 is cut to fit around a stack of rigid holders 1 with the desired number of individual holders 3.

Figure 3:
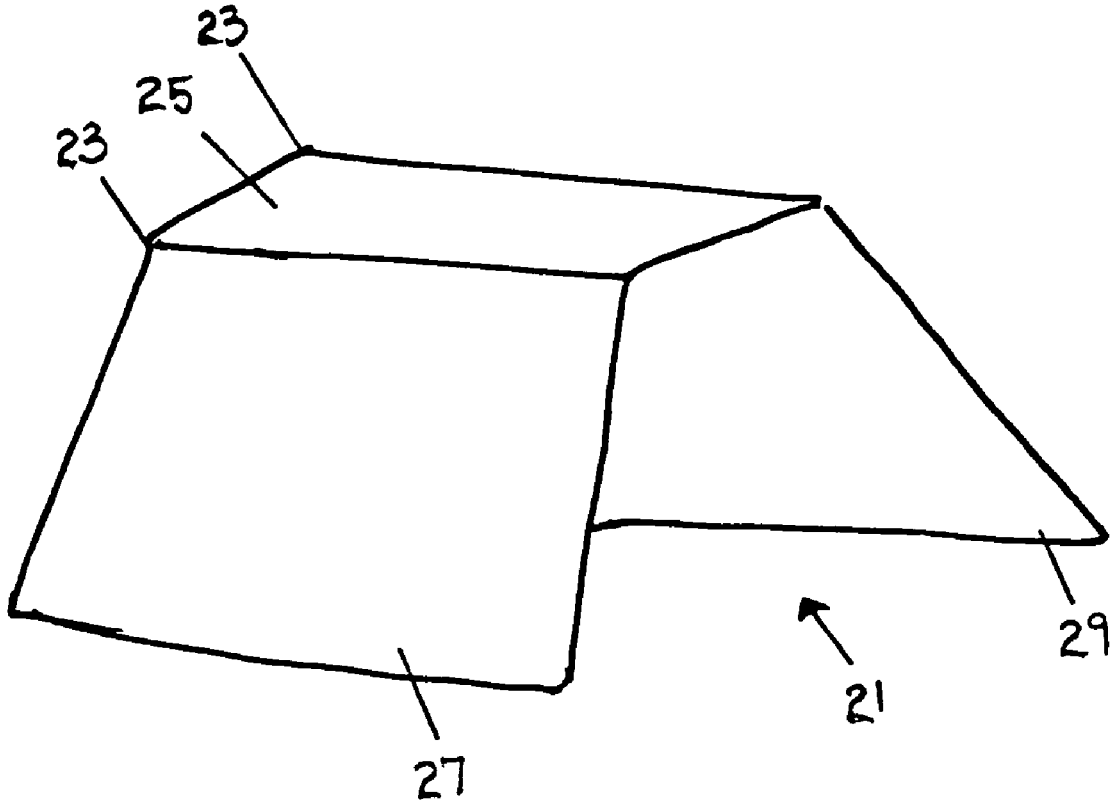
FIG. 3 is a diagram of a graphic insert.

FIG. 3 shows a sheet of flexible, printed graphic material 21. The printed graphic material 21 is cut to fit around a stack of rigid holders 1 with the desired number of individual holders 3. The printed graphic material 21 is creased 23 twice in two parallel lines to form a spine section 25 and a cover section 27 and base section 29 that match the dimensions of the corresponding stack of rigid holders 1.

Figure 4:
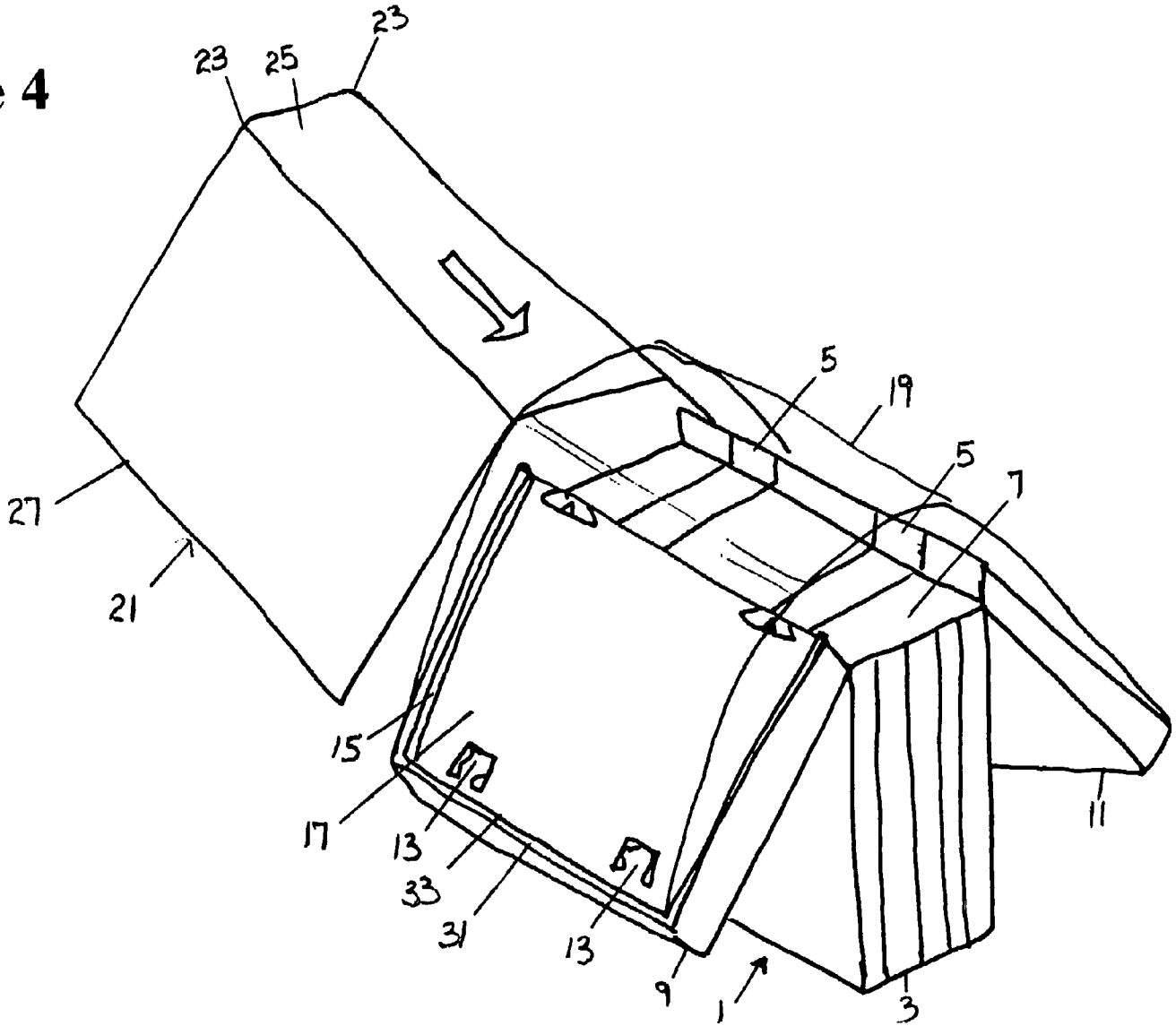
FIG. 4 is a diagram of a graphic insert being placed under a clear, flexible outer cover.

In one embodiment, shown in FIG. 4, a film of clear, flexible material 21 surrounds a stack of one or more rigid holders 1. The clear, flexible material 19 is sonically welded, glued, heat stamped or otherwise attached to the cover holder 9 and base holder 11. The clear, flexible material 19 is attached, along an edge 33 of the material 19, to the cover holder 9, along the outside edge 31 of the holder 9, parallel to the spine 7. The clear, flexible material 19 is not attached to the cover holder 9 along any other edge of the cover 9. The clear, flexible material 19 is then wrapped across the cover 9, bent around the spine 7 and wrapped around the base holder 11. The opposite end 35 of the clear, flexible material 19 is then sonically welded, glued, heat stamped or otherwise attached to an outside edge of the base holder 11 that is opposite to the spine 7.

The clear, flexible material 19 is not bound to the spine 7. When the cover 9 and base rigid holders 11 are lifted away from center rigid holders 3, the clear, flexible material 19 also lifts up, away from the cover 9, base 11 and spine 7. The printed graphic insert 21 is then slid between the clear, flexible material 19 and the cover holder 9, base holder 11 and spine 7. When the cover 9 and base 11 holders are returned to a closed position, the printed graphic insert 21 is trapped under the clear, flexible material 19. The flexible, printed graphic insert 21 is pre-creased 23 to fit into the recessed flat region 17 of the cover holder 9 and base holder 11 and along the spine 7.

Figure 5:
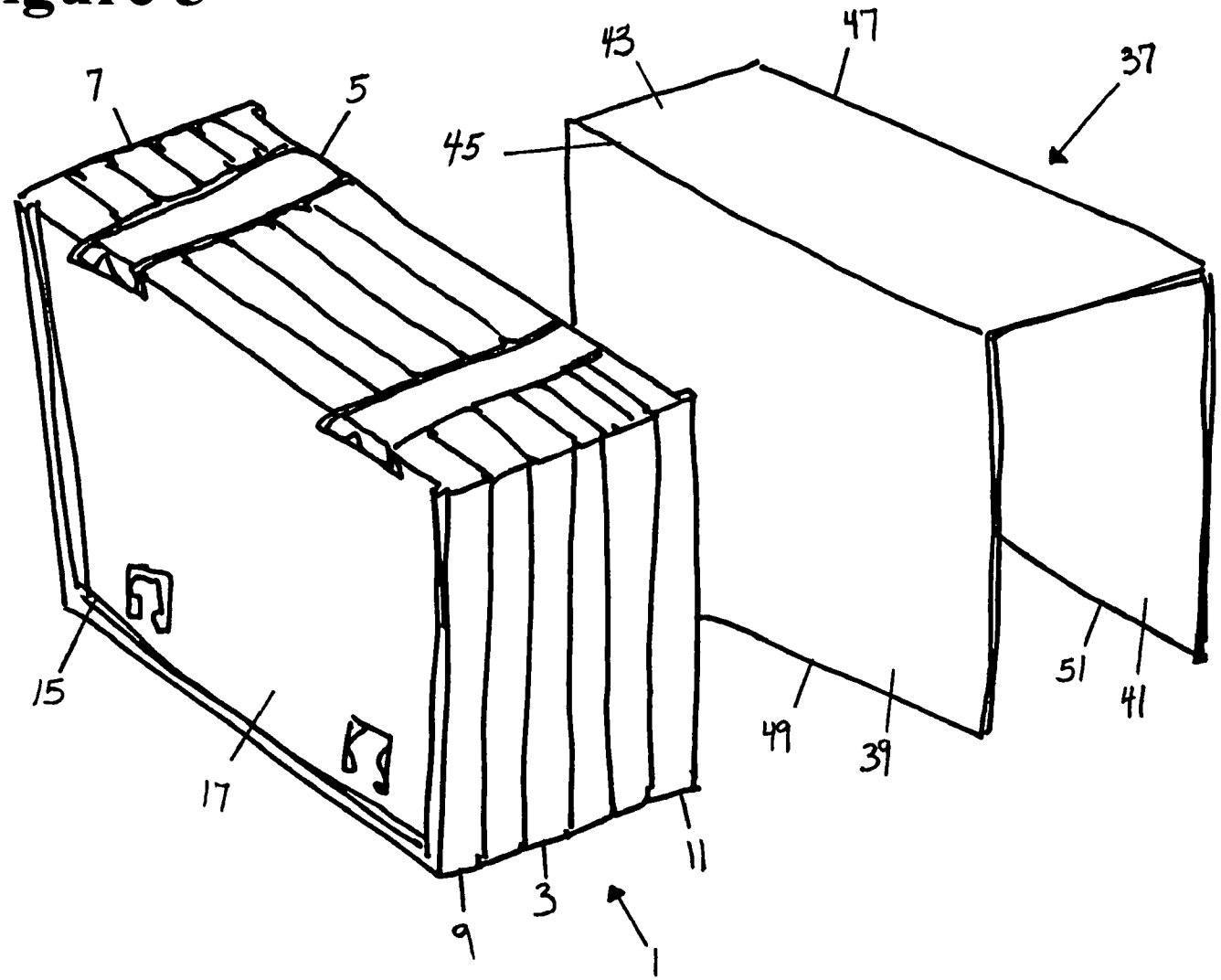
FIG. 5 is a diagram of a stack of rigid holders and a hard outer cover.

In another embodiment, shown in FIG. 5, a hard cover 37 is attached to a stack of one or more hinged rigid holders 1. The hard cover 37 has a cover 39, base 41 and flexible spine 43 sections that are similar in size to the cover holder 9, base holder 11 and spine 7, respectively. The hard cover 37 has graphics printed on the outer surfaces. The flexible spine section 43 connects the cover 39 and base 41 sections of the hard cover 37 and is bent along creases 45, 47. The flexible spine 7 is slightly longer than the combined height of the stack of holders 1.

Figure 6:
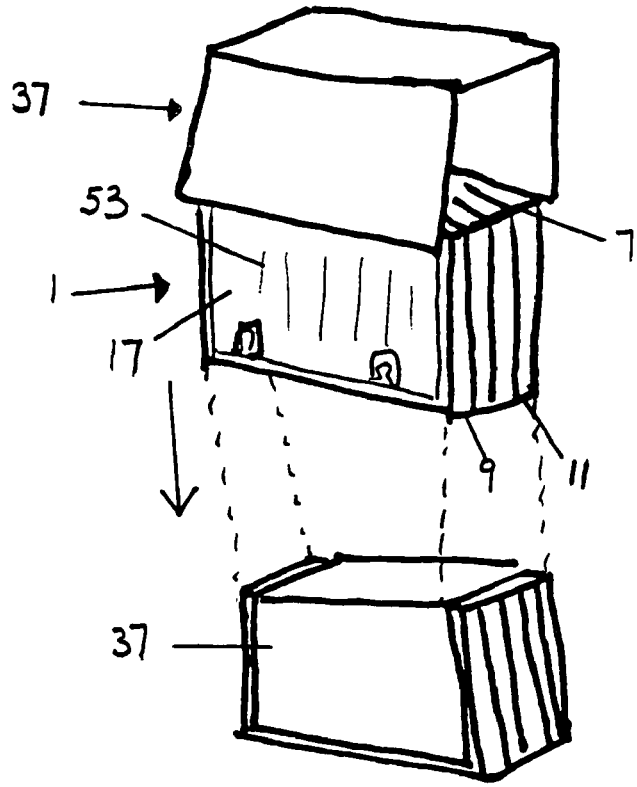
FIG. 6 is a diagram of a hard cover sliding onto a stack of rigid holders.

FIG. 6 shows one method of attaching a hard cover 37, having a flexible spine and rigid covers that are attached to a hinged stack of rigid holders 1. The hard cover 37 is mechanically attached via glue or other adhesives 53 applied on the recessed flat surfaces 17 of the cover holder 9 and base holder 11. The adhesive 53 may alternatively be applied to the underside of the hard cover 37 cover section 39 and base section 41. No adhesive is applied to the spine 7. The hard cover 37 is slid down over the stack of rigid holders 1 until edges of the hard cover 49, 51 contact the ridges 15 around the recessed areas 17 on the cover holder 9 and base holder 11. When fully attached, the hard cover 37 is flush with the rim of the recessed area 17 on the outer holders 9, 11. When the adhesive 53 is set, the cover 37 is permanently attached to the stack of rigid holders 1.

Figure 7:
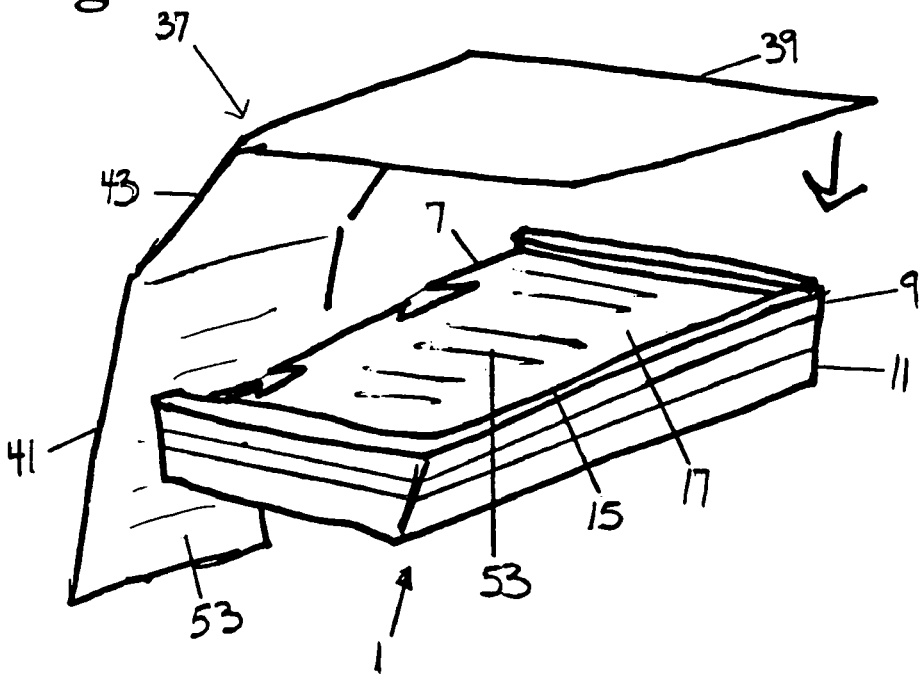
FIG. 7 is a diagram of a hard cover lined up over a rigid holder.

FIG. 7 shows another method of adhering a hard cover 37 to a stack of rigid holders 1. Adhesive 53 is applied to the flat surfaces 17 of the cover 9 and base 11 holders, the underside of hard cover 37 cover 39 and base 41 sections, or both. No adhesive 53 is applied to the spine 7. The hard cover 37 cover section 39 is aligned with the ridge 15 around the cover holder 9 and pressed together. The hard cover 37 is then wrapped around the stack of rigid holders 1 and the hard cover 37 base section 41 is pressed against the flat region 17 of the base holder 11.

Figure 8:
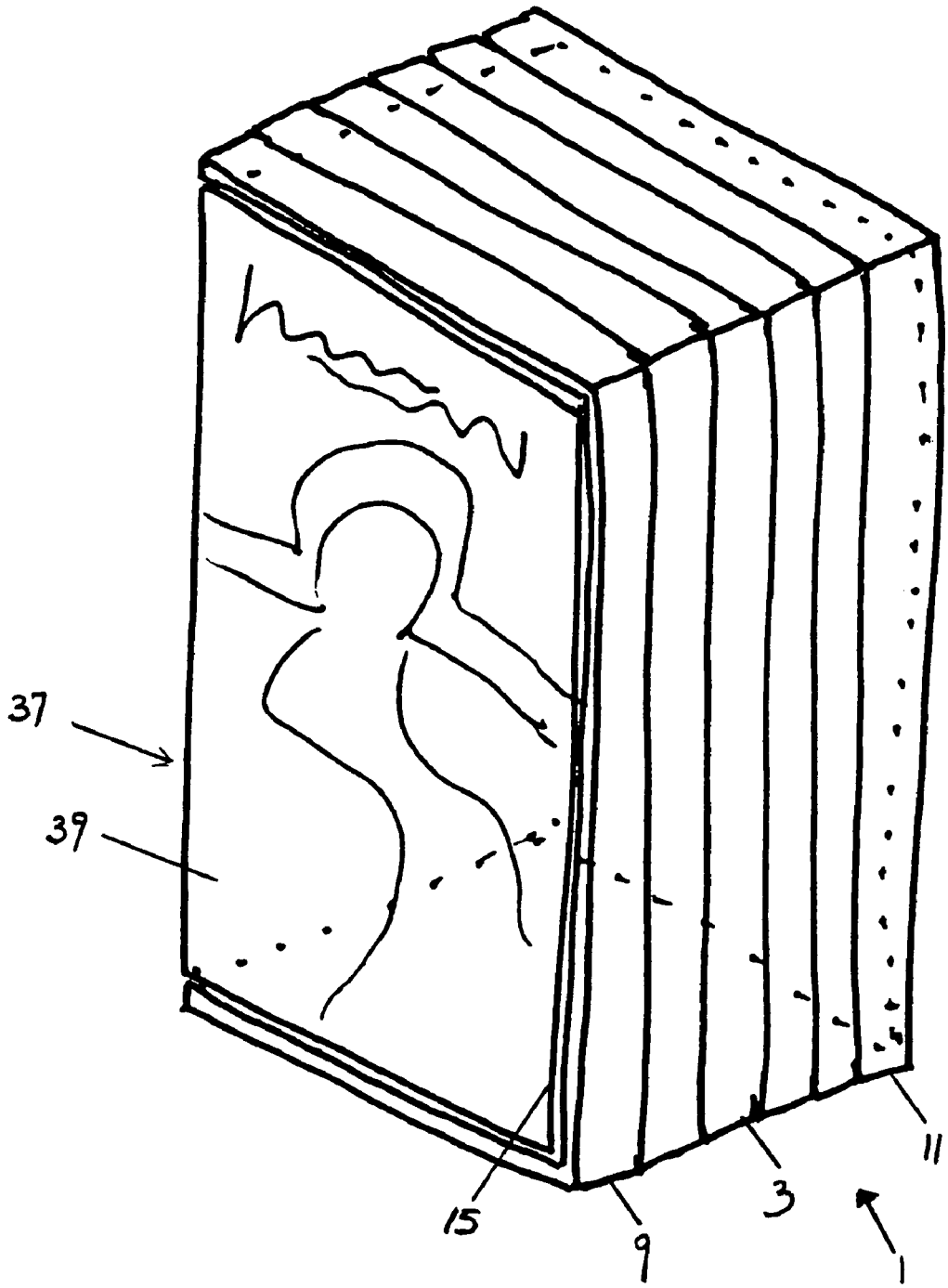
FIG. 8 is a diagram of a flexible soft outer cover glued within rims of a cover and a base on a stack of rigid holders.

FIG. 8 shows the finished hard cover 37 on a stack of rigid holders 1. When the adhesive 53 is set, the hard cover 37 is permanently attached to the stack of rigid holders 1.

Figure 9:
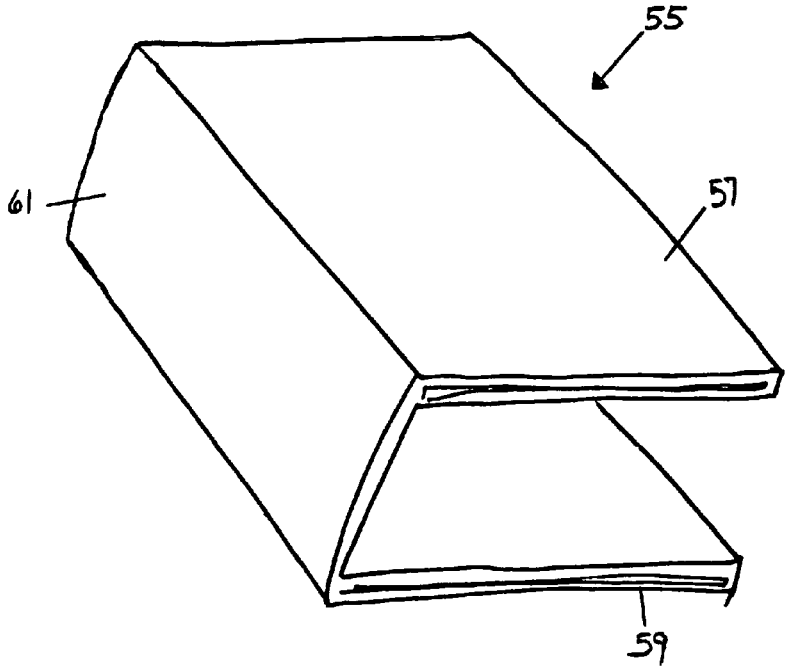
FIG. 9 is a diagram of a book-like hard outer cover with a flexible spine cover in a closed position.
Figure 10:
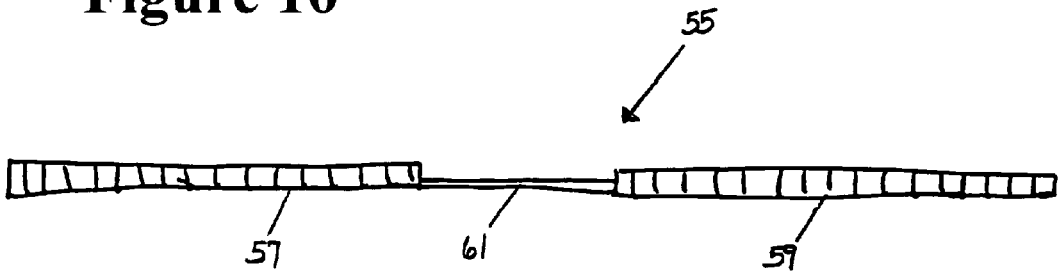
FIG. 10 is a diagram of a book-like cover of FIG. 9 in an open position.

The hard cover 37 may have either a solid spine section 43 or the spine section 43 may be flexible like the binding of a book. FIG. 9 shows a book cover 55 with solid front 57 and back 59 sections and a flexible spine 61 section. The front 57 and back 59 sections are made of rigid board material. They may be single ply or folded over on themselves depending on the needs of each individual package. The spine section 61 is made of a flexible material cut to correspond to the thickness of the stack of rigid holders 1. The spine section 61 is attached to both the front 57 and back 59 sections of the book cover 55. The front 57 and back 59 sections are generally thicker than the spine section 61. FIG. 10 shows the book cover 55 fully opened.

Figure 11:
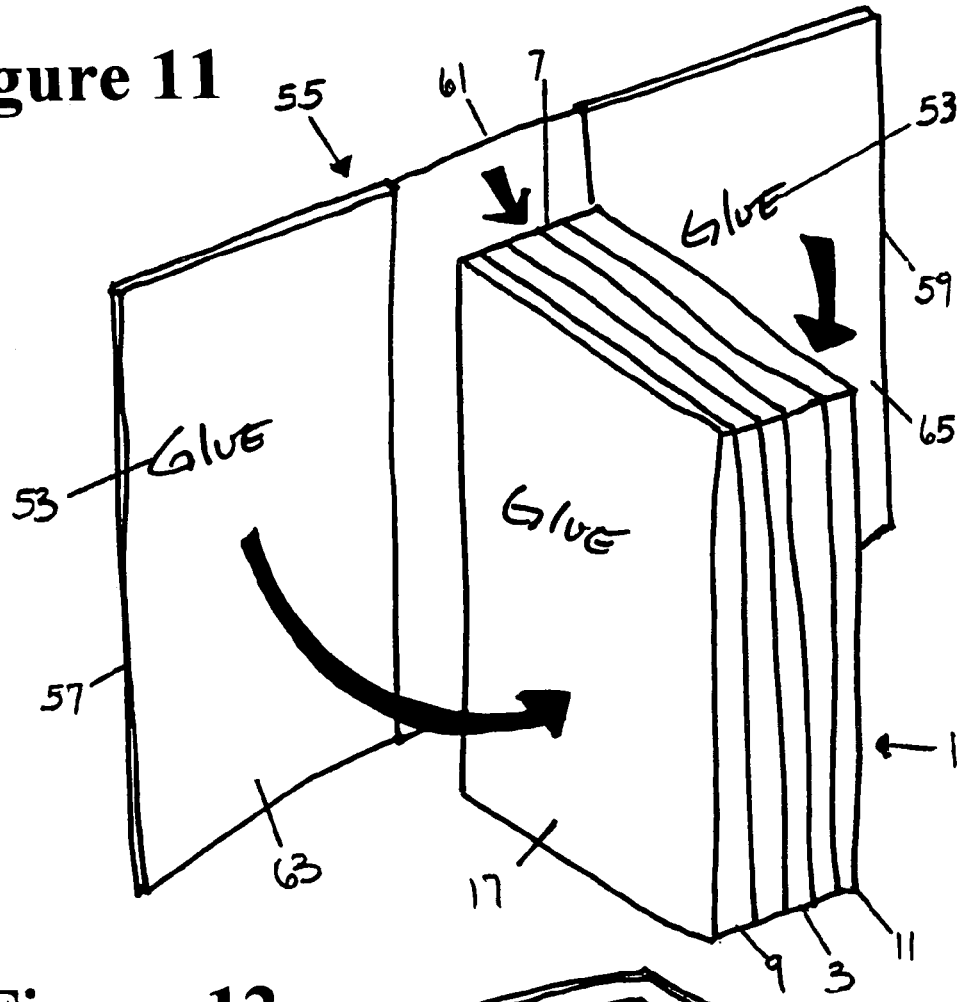
FIG. 11 is a diagram of a rigid book-like outer cover being attached to a stack of rigid holders.

FIG. 11 shows the attachment of the book cover 55 to a stack of rigid holders 1. Glue or other adhesive 53 is placed on the inner surfaces 63, 65 of the front 57 and back 59 sections of the book cover 55. The adhesive 53 fits in the recessed areas 17 of the assembled cover 9 and base 11 rigid holders. Edges of the hard cover extend slightly beyond the rims 15 of the recessed areas 17 of the cover 9 and base 11.

Figure 12:
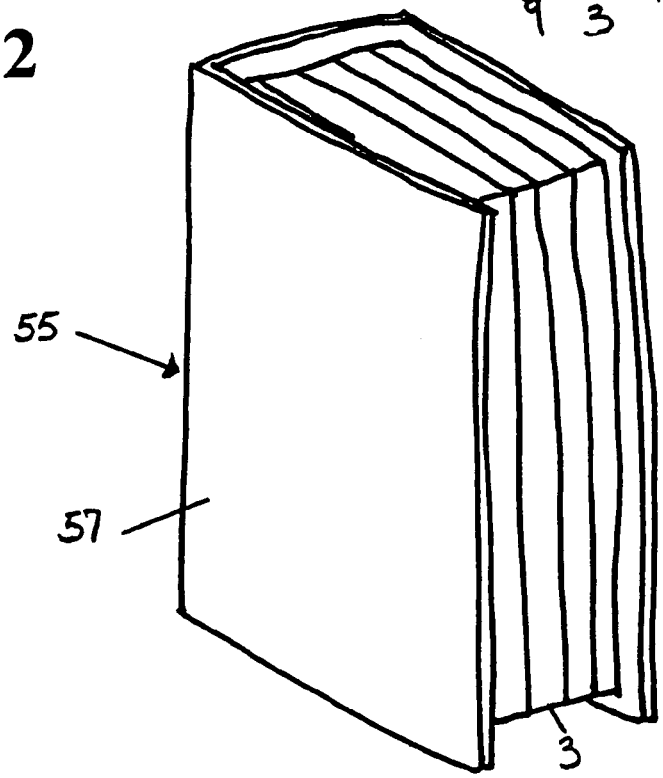
FIG. 12 is a diagram of a completed hard outer cover system.

Adhesive 53 is placed on the flat surfaces 17 of the cover 9 and base 11 holders. No adhesive 53 is placed on the flexible spine section 61. The spine section 61 is placed adjacent the spine 7 of the stack of rigid holders 1. Then the front section 57 of the book cover 55 is wrapped into place against the cover holder 9. The back section 59 of the book cover 55 is then wrapped against the base holder 11. FIG. 12 shows the book cover 55 finally attached to the cover and base of the stack of rigid holders 1.

Alternatively, a soft cover fits into the recessed areas 17 on the cover 9 and base 11. When fully attached, the soft cover is flush against rims 15 of the recessed areas 17 on the rigid cover 9 and base 11.

The outer covers may have rigid or flexible covers 9 and bases 11. The spine section 7 may be flexible, like the binding of a book. The outer cover 9 and base 11 are made of rigid or flexible material, while the spine 7 is made of a flexible material.

Figure 13:
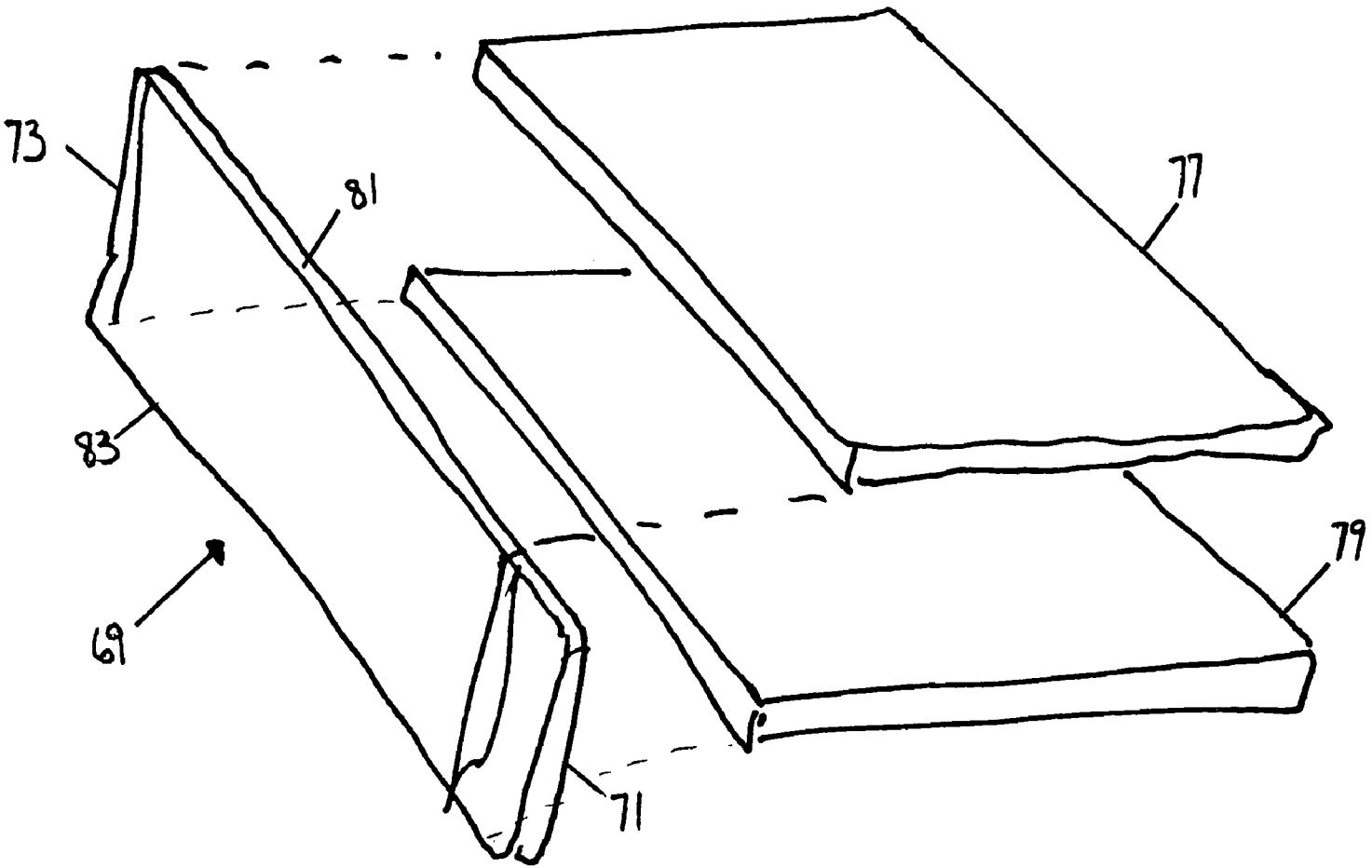
FIG. 13 is a diagram of the components of a clear envelope outer cover system.

FIG. 13 shows a graphic insert method using a spine pocket 69. An envelope 69 of clear material is sized to match the dimensions of the spine 7 of a stack of rigid holders 1. The ends 71, 73 of the clear envelope 69, running perpendicular to the spine 7, are open. A cover 77 and base 79 section of clear cover material may be attached along edges 81, 83 of the spine pocket 69.

Figure 14:
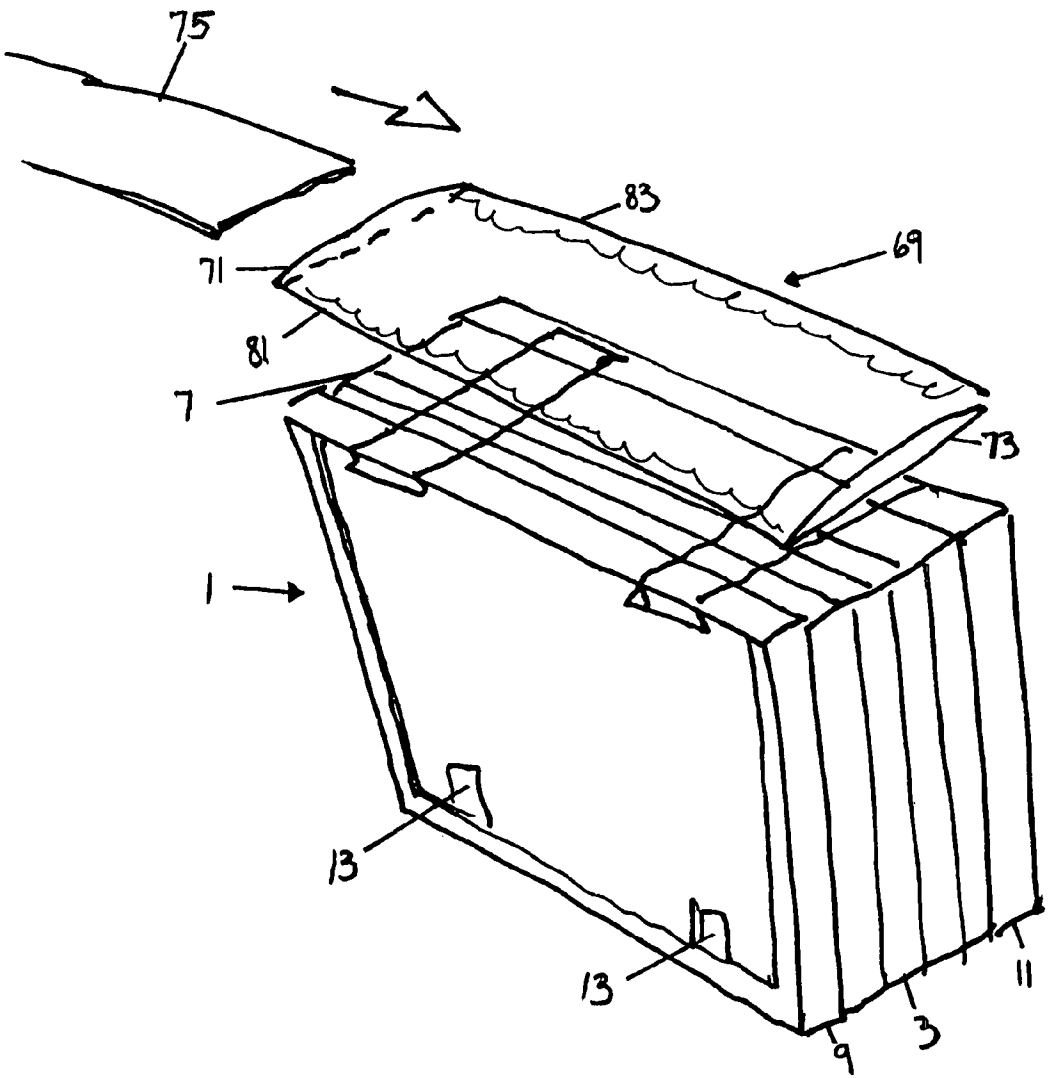
FIG. 14 is a diagram of a clear outer cover envelope with a slide-in graphic insert.

FIG. 14 shows the attachment of the spine pocket 69 and insertion of a graphic insert 75. The ends 71, 73 of the clear envelope 69, running perpendicular to the spine 7, are open to allow the graphic insert 75 to slide in through either open end 71, 73. The graphic insert 75 is sized to fit within the clear envelope 69. The clear envelope 69 is sonically sealed, glued, heat stamped or otherwise closed along the two sides of the envelope 69 along the cover 9 and base 11. The spine pocket 69 edges 81, 83 are then sonically sealed to the spine 7 edges of the cover 9 and base 11. When a graphic insert 75 is slid into the envelope 69, it is readable by consumers. This embodiment may also be combined with a clear cover system. A booklet of information or other pamphlet may be clipped into molded clips 13 and read through a clear or printed outer cover system. Thus, information is provided through the clear cover and with the graphic insert 75.

While the invention has been described with reference to specific embodiments, modifications and variations of the invention may be constructed without departing from the scope of the invention, which is defined in the following claims.

The invention claimed is:

1. A graphic book cover apparatus comprising:

a stack of rigid holders comprising a cover holder, a base holder and one or more individual rigid holders between the cover holder and the base holder, a raised rim along all edges of the cover holder and base holder except the spine edge, a flat central region on outside surfaces of the cover holder and base holder within the raised rim, a sheet of clear, flexible cover material connected to an edge of the cover holder opposite the spine edge and connected to an edge of the base holder opposite the spine edge, and a printed, flexible graphic insert for inserting between the stack of rigid holders and the sheet of clear, flexible cover material, further comprising hinges connecting the stack of rigid holders together, wherein the hinges are hinged mechanical binding clips attached to a spine of the stack of rigid holders and locked into position.

2. The apparatus of claim 1, wherein the one or more individual rigid holders are containers for holding digital media.

3. The apparatus of claim 1, further comprising molded clips in the cover holder and base holder for holding printed materials.

4. The apparatus of claim 1, wherein the connection between the clear, flexible cover material and the cover holder and base holder is by means of sonic welding, glue, or heat stamping.

5. The apparatus of claim 1, wherein the clear, flexible cover material is sized to fit the dimensions of the stack of rigid holders.

6. The apparatus of claim 1, wherein the printed, flexible graphic insert is creased in two parallel lines for creating a cover section, spine section and base section of the graphic insert that matches the dimensions of the cover holder, spine of the stack of rigid trays, and the cover holder.

7. The apparatus of claim 1, wherein an edge of the clear, flexible cover material is connected to the raised rim opposite the spine on the cover holder and an opposite edge of the clear, flexible cover material is connected to the raised rim opposite the spine on the base holder.

8. The apparatus of claim 7, wherein the clear, flexible cover material creates a tight cover when the stack of rigid holders is in a closed position.

9. The apparatus of claim 8, wherein the clear, flexible cover material rises away from the stack of rigid holders when the stack of rigid holder is in an opened position.

10. The apparatus of claim 1, wherein the clear, flexible cover material wraps around the stack of rigid trays within the flat central region on the outside surface of the cover holder, across a spine of the stack of rigid holders, and within the flat central region on the outside surface of the base holder.

11. The apparatus of claim 1, wherein the clear, flexible cover material is not connected to a spine of the stack of rigid holders.

12. The apparatus of claim 1, wherein the printed, flexible graphic insert is trapped between the clear, flexible cover material and the stack of rigid holders when the stack of rigid holders is in a closed position.

13. The apparatus of claim 1, wherein the printed, flexible graphic insert is pre-creased for matching the dimensions of the stack of rigid holders.

14. The apparatus of claim 13, wherein the printed, flexible graphic insert fits within the flat central region on the outside surface of the cover holder, around the spine of the stack of rigid trays, and within the flat central region on the outside surface of the base holder.

15. A graphic book cover method comprising:

providing a stack of rigid holders comprising a cover holder, a base holder and one or more individual rigid holders between the cover holder and the base holder, wherein a raised rim runs along all edges of the cover holder and base holder except the spine edge for creating a flat central region on an outside surfaces of the cover holder and base holder within the raised rim, connecting an edge of a sheet of clear, flexible cover material connected to an edge of the cover holder opposite the spine edge, wrapping the clear, flexible cover material against the flat central region of the cover holder, wrapping the clear, flexible cover material against a spine section of the stack of rigid holders, wrapping the clear, flexible cover material against the flat central region of the base holder, connecting an opposite edge of the clear, flexible cover material to an edge of the base holder opposite the spine edge, raising the cover holder and base cover away from the individual rigid holders, inserting a printed, flexible graphic insert between the stack of rigid holders and the sheet of clear, flexible cover material, and lowering the cover holder and base cover towards the individual rigid holders, wherein hinges connect the stack of rigid holders together, wherein the hinges are hinged mechanical binding clips attached to a spine of the stack of rigid holders and locked into position.

16. The method of claim 15, wherein the one or more individual rigid holders are containers for holding digital media.

* * * * *